US010369684B2

(12) United States Patent
Chen

(10) Patent No.: US 10,369,684 B2
(45) Date of Patent: Aug. 6, 2019

(54) SOCKET WRENCH HAVING A PAWL THROUGH COVER

(71) Applicant: Kuo Lung Chen, Nantou County (TW)

(72) Inventor: Kuo Lung Chen, Nantou County (TW)

(73) Assignee: Fine Forge Industry Corporation, Nantou County (TW)

( * ) Notice: Subject to any disclaimer, the term of this patent is extended or adjusted under 35 U.S.C. 154(b) by 176 days.

(21) Appl. No.: 15/697,460

(22) Filed: Sep. 7, 2017

(65) Prior Publication Data

US 2017/0361429 A1 Dec. 21, 2017

(51) Int. Cl.

| | |
|---|---|
| ***B25B 13/46*** | (2006.01) |
| ***B25B 23/00*** | (2006.01) |
| ***B25B 17/00*** | (2006.01) |
| ***B25G 1/00*** | (2006.01) |
| ***B25B 13/04*** | (2006.01) |
| ***B25B 13/08*** | (2006.01) |

(52) U.S. Cl.

CPC ..... *B25B 13/462* (2013.01); *B25B 13/04* (2013.01); *B25B 13/08* (2013.01); *B25B 13/463* (2013.01); *B25B 17/00* (2013.01); *B25B 23/0028* (2013.01); *B25G 1/00* (2013.01)

(58) Field of Classification Search

None

See application file for complete search history.

(56) References Cited

U.S. PATENT DOCUMENTS

| | | | | |
|---|---|---|---|---|
| 5,499,559 | A * | 3/1996 | Lin | B25B 13/462 192/44 |
| 5,595,095 | A * | 1/1997 | Hillinger | B25B 13/461 81/58.3 |
| 2014/0157959 | A1* | 6/2014 | Yang | B25B 13/461 81/63 |

* cited by examiner

*Primary Examiner* — Sarah B McPartlin

(57) ABSTRACT

A socket wrench includes a ratcheting end including a circular opening, a crescent recess disposed on one surface, the crescent recess being adjacent to the circular opening and communicating therewith, the crescent recess having a through hole open to the other surface, and two opposite cavities at both ends of the crescent recess respectively; a cylindrical socket disposed in the circular opening; a crescent cover including two opposite projections on an outer surface, a circular hole in an intermediate portion, and two grooves adjacent to the projections respectively, the crescent cover being disposed on the crescent recess with the projections positioned in the cavities respectively; a pivotal pawl having a threaded hole, the pivotal pawl being disposed through the circular hole to align with the through hole; and a threaded fastener driven through the through hole into the threaded hole to pivotably fasten the pivotal pawl.

1 Claim, 5 Drawing Sheets

SOCKET WRENCH HAVING A PAWL THROUGH COVER

BACKGROUND OF THE INVENTION

1. Field of the Invention

The invention relates to socket wrenches and more particularly to a socket wrench having a pivotal pawl disposed through a cover.

2. Description of Related Art

A conventional socket wrench comprises a ratchet mechanism for allowing a nut to be tightened or loosened with a reciprocating motion without requiring that the wrench be removed and refitted after each turn.

While the socket wrench enjoys its success in the market, continuing improvements in the exploitation of socket wrench are constantly being sought.

SUMMARY OF THE INVENTION

It is therefore one object of the invention to provide a socket wrench comprising a ratcheting end including a circular opening, a crescent recess disposed on one surface, the crescent recess being adjacent to the circular opening and communicating therewith, the crescent recess having a through hole open to the other surface, and two opposite cavities at both ends of the crescent recess respectively; a cylindrical socket disposed in the circular opening; a crescent cover including two opposite projections on an outer surface, a circular hole in an intermediate portion, and two grooves adjacent to the projections respectively, the crescent cover being disposed on the crescent recess with the projections positioned in the cavities respectively; a pivotal pawl having a threaded hole, the pivotal pawl being disposed through the circular hole to align with the through hole; and a threaded fastener driven through the through hole into the threaded hole to pivotably fasten the pivotal pawl; wherein the pivotal pawl is configured to mesh with ratchet teeth of the cylindrical socket.

The above and other objects, features and advantages of the invention will become apparent from the following detailed description taken with the accompanying drawings.

DETAILED DESCRIPTION OF THE INVENTION

Figure 1:
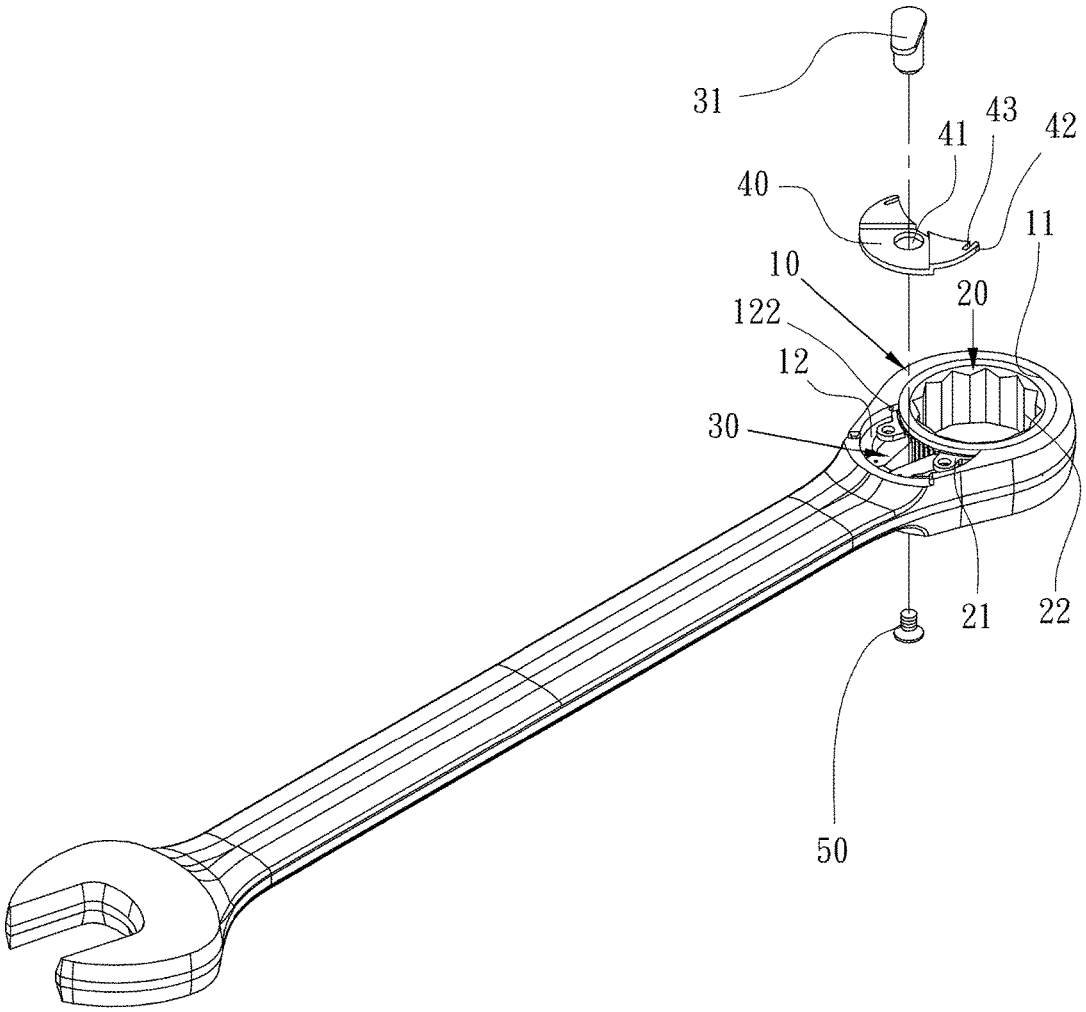
FIG. 1 is an exploded perspective view of a socket wrench according to a preferred embodiment of the invention.
Figure 2:
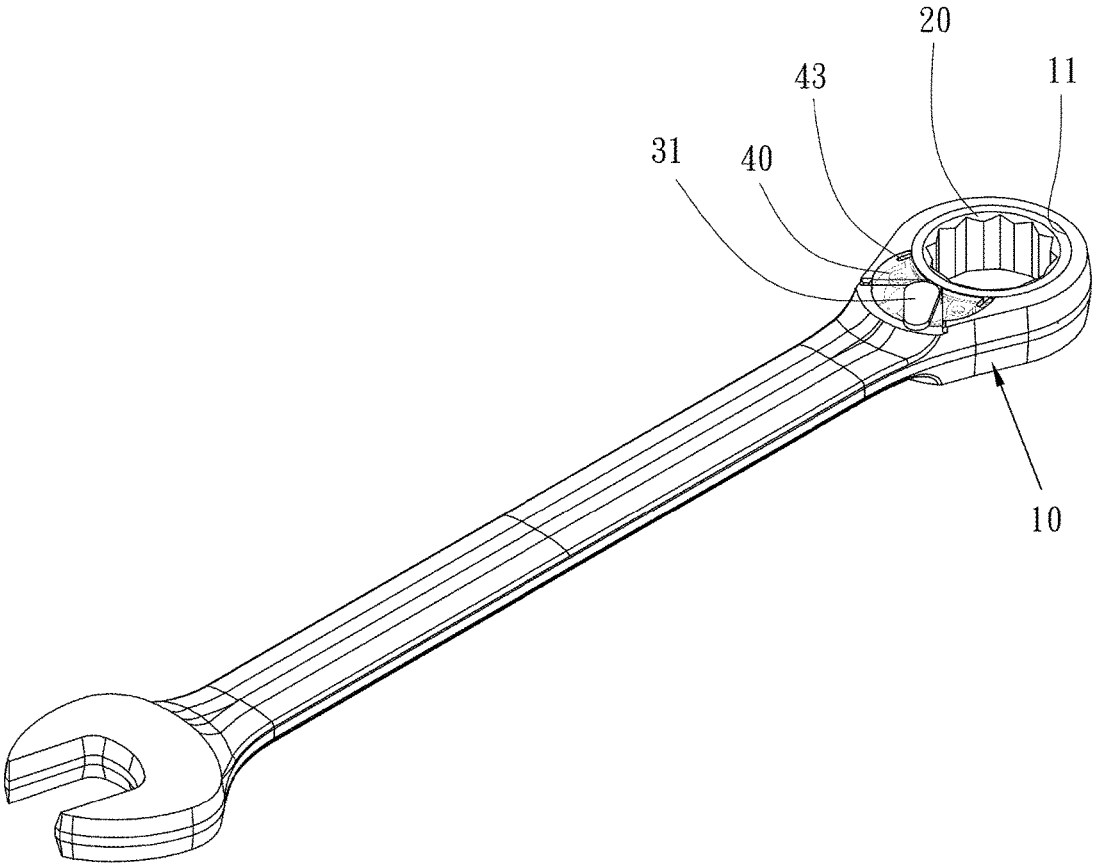
FIG. 2 is a perspective view of the assembled socket wrench.
Figure 3:
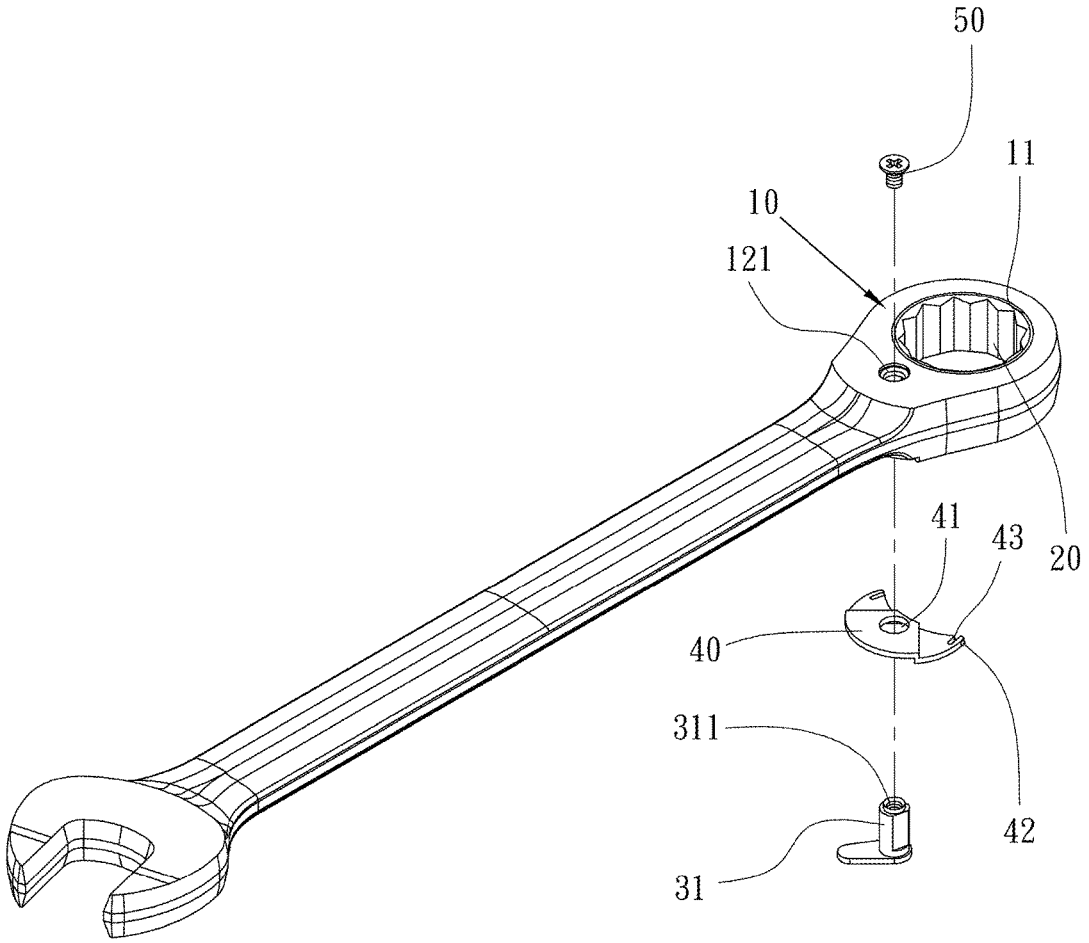
FIG. 3 is a view similar to FIG. 1 but viewed from an opposite angle.
Figure 4:
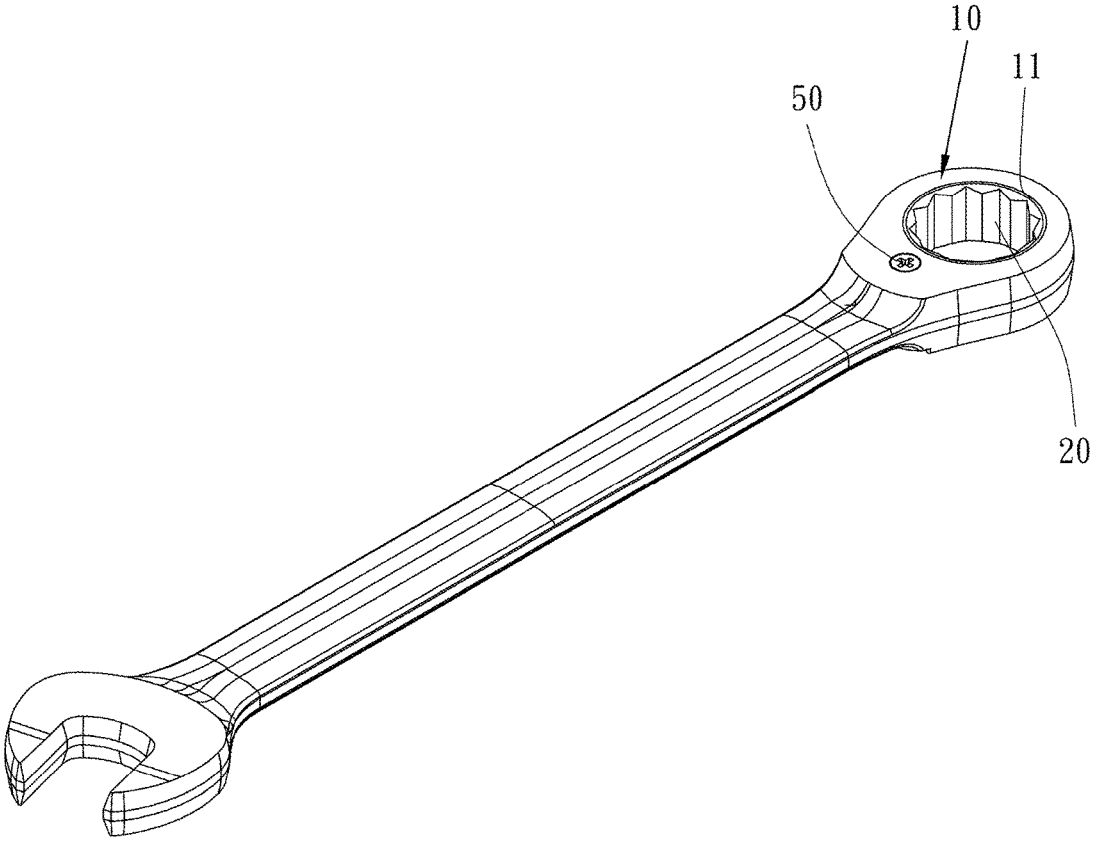
FIG. 4 is a view similar to FIG. 2 but viewed from an opposite angle.

Referring to FIGS. 1 to 5, a socket wrench in accordance with the invention comprises the following components as discussed in detail below.

A ratcheting end 10 includes a circular opening 11, a crescent recess 12 disposed on one surface, the recess 12 being adjacent to the opening 11 and communicating therewith, the recess 12 having a through hole 121 open to the other surface, and two opposite cavities 122 at both ends of the crescent recess 12 respectively. A cylindrical socket 20 includes two fastening members 21 for disposing the cylindrical socket 20 in the circular opening 11. A pivotal pawl assembly 30 is disposed in the crescent recess 12 and configured to mesh with ratchet teeth 22 of the socket 20 to hold the socket 20 against rotation when so desired. The pivotal pawl assembly 30 includes a pivotal pawl 31 having a threaded hole 311.

A crescent cover 40 includes two opposite projections 42 on an outer surface, a circular hole 41 in an intermediate portion, and two grooves 43 adjacent to the projections 42 respectively. The crescent cover 40 is disposed on the crescent recess 12 with the projections 42 positioned in the cavities 122 respectively. The pivotal pawl 31 is disposed through the circular hole 41 to align with the through hole 121. A screw 50 is driven through the through hole 121 into the threaded hole 311 to pivotably fasten the pivotal pawl 31.

Figure 5:
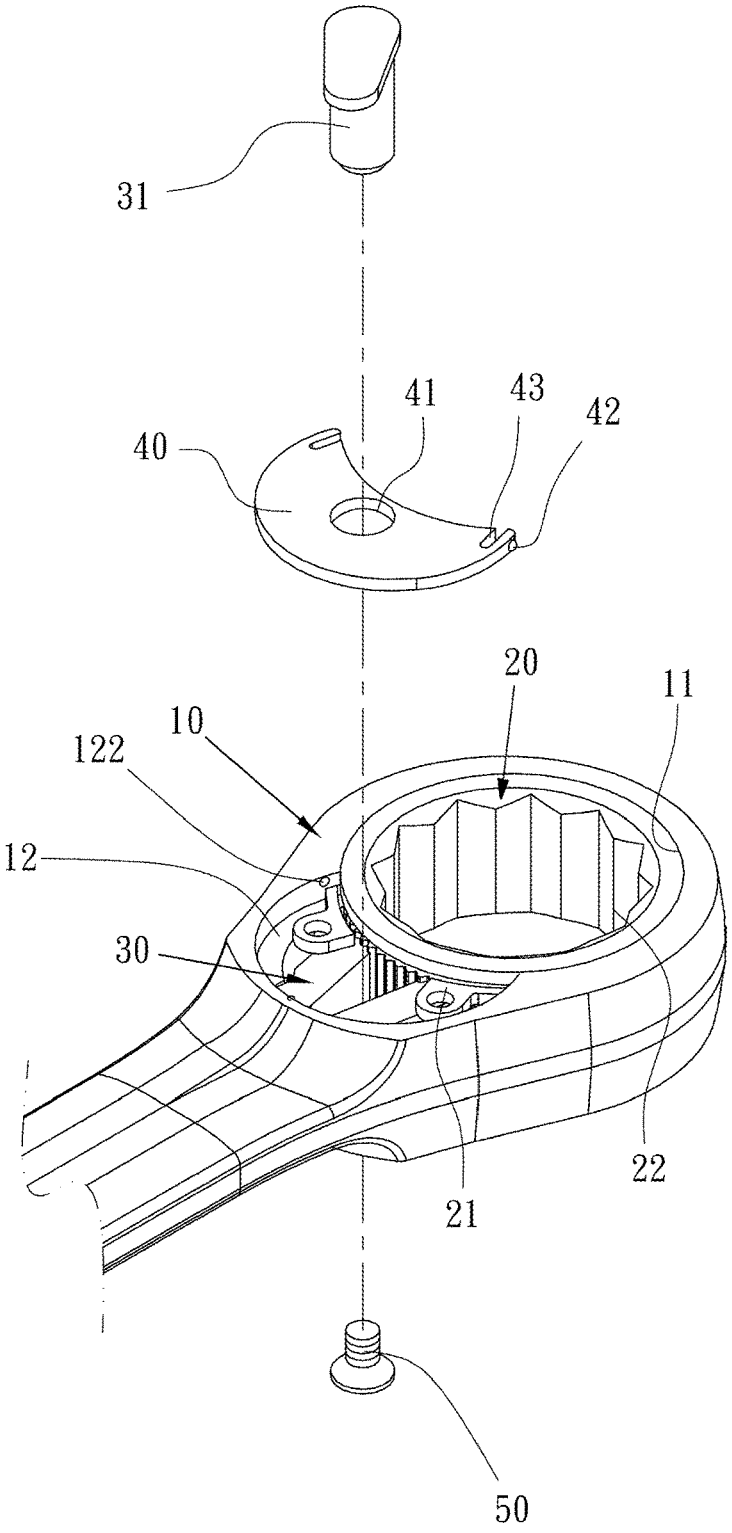
FIG. 5 is an enlarged view of a ratcheting end of the socket wrench showing another preferred embodiment of the cover.

As shown in FIG. 5 specifically, another preferred embodiment of the cover 40 has a flat surface.

While the invention has been described in terms of preferred embodiments, those skilled in the art will recognize that the invention can be practiced with modifications within the spirit and scope of the appended claims.

What is claimed is:

1. A socket wrench comprising:

a ratcheting end including a circular opening, a crescent recess disposed on one surface, the crescent recess being adjacent to the circular opening and communicating therewith, the crescent recess having a through hole open to an opposite surface, and two opposite cavities at both ends of the crescent recess respectively;

a cylindrical socket disposed in the circular opening;

a crescent cover including two opposite projections on an outer surface, a circular hole in an intermediate portion, and two grooves adjacent to the projections respectively, the crescent cover being disposed on the crescent recess with the projections positioned in the cavities respectively;

a pivotal pawl having a threaded hole, the pivotal pawl being disposed through the circular hole to align with the through hole; and a threaded fastener driven through the through hole into the threaded hole to pivotably fasten the pivotal pawl;

wherein the pivotal pawl is configured to mesh with ratchet teeth of the cylindrical socket.

* * * * *